US006733102B2

(12) United States Patent
Hosono

(10) Patent No.: US 6,733,102 B2
(45) Date of Patent: May 11, 2004

(54) INK JET RECORDING APPARATUS

(75) Inventor: Satoru Hosono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/977,945

(22) Filed: Oct. 17, 2001

(65) Prior Publication Data

US 2002/0051022 A1 May 2, 2002

(30) Foreign Application Priority Data

Oct. 17, 2000 (JP) ..... 2000-316256
Sep. 26, 2001 (JP) ..... 2001-293252

(51) Int. Cl.[7] ..... B41J 29/38; B41J 2/195; B41J 25/38

(52) U.S. Cl. ..... 347/14; 347/5; 347/8

(58) Field of Search ..... 347/14, 8, 51

(56) References Cited

U.S. PATENT DOCUMENTS 4,927,277 A * 5/1990 Niikawa ..... 400/56
5,411,659 A 5/1995 Nichols ..... 210/130
5,806,992 A * 9/1998 Ju ..... 400/56
5,988,784 A * 11/1999 Takemura et al. ..... 347/8
6,336,703 B1 * 1/2002 Otsuki ..... 347/41
6,341,843 B1 * 1/2002 Takemura et al. ..... 347/49

FOREIGN PATENT DOCUMENTS

EP 0 970 816 A2 1/2000 ..... B41J/2/21
EP 0 982 146 A2 3/2000 ..... B41J/13/12
EP 0 995 603 A2 4/2000 ..... B41J/2/185
JP 10-264413 10/1998 ..... B41J/2/205

* cited by examiner

*Primary Examiner*—Stephen D. Meier
*Assistant Examiner*—Alfred Dudding
(74) *Attorney, Agent, or Firm*—Sughrue Mion, PLLC

(57) ABSTRACT

A platen gap from a nozzle orifice is detected by a platen gap detecting sensor (16). A control section (46) limits usable recording modes to a high-speed recording mode and a first high-resolution recording mode in case that the detected platen gap is a large gap. At this time, in case that a control command from a host computer is a command for specifying a second high-resolution recording mode, the recording mode to be used is switched to the first high-resolution recording mode.

22 Claims, 10 Drawing Sheets

| PLATEN GAP | SMALL GAP | | LARGE GAP | |
|---|---|---|---|---|
| PRINT MODE | EDGE | BORDER FREE | EDGE | BORDER FREE |
| HIGH-SPEED (VSD1) | ○ | ○ | ○ | ○ |
| FIRST HIGH-RESOLUTION (VSD2) | ○ | ○ | ○ | ○ |
| SECOND HIGH-RESOLUTION (VSD3) | ○ | × | × | × |

INK JET RECORDING APPARATUS

BACKGROUND OF THE INVENTION

The present invention relates to an ink jet recording apparatus in which a plurality of recording modes which set respectively a different correspondence of gradation data and the ink amount of a dot are prepared and these recording modes are applied selectively.

As a typical ink jet recording apparatus (hereinafter simply referred to as a recording apparatus), a printer and a plotter are known well. In this recording apparatus, for example, a drive signal in which a plurality of drive pulses are connected in series is generated. Printing data including gradation data is transmitted to a recording head, and the necessary drive pulses are selected from the drive signal on the basis of this transmitted printing data and supplied to a piezoelectric vibrator. Hereby, the amount of ink droplets ejected from a nozzle orifice is changed according to the gradation data.

For example, in a printer that sets four gradations including non-recording printing data (gradation data 00), small-dot printing data (gradation data 01), middle-dot printing data (gradation data 10), and large-dot printing data (gradation data 11), the ink droplets that are different in the amount according to the respective gradations are ejected. Further, a plurality of recording modes are prepared, which respectively set a different correspondence of gradation data and the ink amount of a dot, and drive control in which the plurality of recording modes are selectively applied is performed. For example, speedy recording is performed by applying a high-speed recording mode in which a dot having the comparatively large diameter is recorded, or recording of higher image quality is performed by setting a high-resolution recording mode in which a dot having the comparatively small diameter even in the same gradation data is recorded. Hereby, this printer corresponds to various requests.

On the other hand, the thickness of a recording sheet on which an image is recorded is various so that plain paper is about 0.1 mm in thickness, a postal card is about 0.26 mm in thickness and board paper is about 1.2 mm in thickness. Therefore, an adjustment mechanism for changing a distance (platen gap) between a platen for guiding the recording sheet and the recording head is provided. This adjustment mechanism is generally constituted so as to move the recording head up and down, and it sets a gap from a nozzle orifice of the recording head to a surface of the recording sheet in the predetermined range.

Recently, a recording apparatus is also considered, which has a border free print mode in which printing is performed throughout all the area of four sides of the recording sheet. In this recording apparatus, data to be printed in a range that is wider a little than the width and length of the recording sheet is prepared and ink droplets are ejected up to the region over the four sides. Then, in this recording apparatus, the ink droplets ejected to the outside of the four sides of the recording sheet are absorbed by an absorber provided in the corresponding position on the rear surface of the platen.

Recently, greater improvement of image quality is requested for the recording apparatus. In order to correspond to this request, it is necessary to reduce further the diameter of a recording dot, that is, to reduce the amount of the ink droplet. However, in case of employing a minute ink droplet (referred to as a super-minute ink droplet for convenience of description), of which the amount of ink is about 2 pL (picoliter) that is extremely small, viscous resistance of air makes a great influence. Therefore, it is difficult for the super-minute ink droplet to obtain the required jet speed, and in case that the distance from the nozzle orifice to the recording sheet is large, it is difficult to cause the ink droplet to reach the recording sheet. Particularly, in case that the platen gap is set large by the above platen gap adjustment mechanism, it is more difficult to cause the ink droplet to reach the recording sheet.

Further, though it is necessary to cause the ink droplet to reach the absorber in the border free print mode, since this absorber is provided on the rear surface of the platen, the distance from the nozzle orifice to the platen is farther than the distance from the nozzle orifice to the recording sheet. Therefore, it is difficult to cause the absorber to absorb the super-minute ink droplet.

SUMMARY OF THE INVENTION

In view of these circumstances, an object of the invention is to provide an ink jet recording apparatus that can prevent a super-minute ink droplet from becoming misty.

In order to solve the aforesaid object, the invention is characterized by having the following arrangement.

(1) An ink jet recording apparatus includes:

a recording head for ejecting an ink droplet from an nozzle orifice according to supply of a drive pulse to a pressure generating element;

a recording node setting unit for setting a recording mode from a plurality of recording modes that are different in a correspondence of gradation data and amount of ink;

a drive signal generator which can generate various kinds of drive signals including drive pulses according to the recording mode, wherein the drive signal generator generates the drive signal according to the recording mode set by the recording mode setting unit, and the drive pulse extracted from the generated drive signal is supplied to the pressure generating element;

a gap detector for detecting a platen gap from the nozzle orifice: and a recording mode limit unit for limiting usable recording modes to a part of the plurality of recording modes according to the platen gap detected by the gap detector.

(2) An ink jet recording apparatus comprising:

a recording head for ejecting an ink droplet from an nozzle orifice according to supply of a drive pulse to a pressure generating element;

a recording mode setting unit for setting a recording mode from a plurality of recording modes that are different in a correspondence of gradation data and amount of ink;

a drive signal generator which can generate various kinds of drive signals including drive pulses according to the recording mode, wherein the drive signal generator generates the drive signal according to the recording mode set by the recording mode setting unit, and the drive pulse extracted from the generated drive signal is supplied to the pressure generating element;

a recording mode limit unit for limiting usable recording modes to a part of the plurality of recording modes when a border free print mode in which printing is performed up to borders of a recording sheet is set.

(3) The ink jet recording apparatus according to (1) or (2) further comprising:

a recording mode switching unit for switching the recording mode to one of usable recording modes judged by the recording mode limit unit when the recording mode set by the recording mode setting unit is not the usable recording mode.

(4) The ink jet recording apparatus according to any one of (1) to (3) further comprising:

a notice unit for notifying that the recording mode set by the recording mode setting unit is not suitable when the recording mode limit unit judges that the recording mode set by the recording mode setting unit is not suitable.

(5) The ink jet recording apparatus according to (4), wherein the notice unit notifies that the recording mode is not suitable by sending an error code to a host computer.

(6) The ink jet recording apparatus according to any one of (1) to (5), wherein inks ejected respectively by h the various kinds of drive signals generated by the drive signal generator are different in the minimum amount.

(7) The ink jet recording apparatus according to (1), wherein the recording mode limit unit limits the usable recording modes to a part of the plurality of recording modes when a border free print mode in which printing is performed up to borders of a recording sheet is set.

(8) The ink jet recording apparatus according to (2) further comprising:

a gap detector for detecting a platen gap from the nozzle opening, wherein the recording mode limit unit limits the usable recording modes to a part of the plurality of recording modes according to the platen gap detected by the gap detector.

(9) An ink jet recording apparatus includes:

a recording mode setting unit for setting a recording mode from a plurality of recording modes that are difference in a correspondence of gradation data and amount of ink;

a drive signal generator for generating a drive signal selected from various kinds of drive signals according to the recoding mode set by the recording mode setting unit;

a recording head for ejecting an ink droplet from an nozzle orifice thereof according to the drive pulse; and a recording mode limit unit for judging whether the recording mode set by the recording mode setting unit is a usable recording mode for recording.

(10) The ink jet recording apparatus according to (9) further comprising a gap detector for detecting a platen gap from the nozzle orifice, wherein the recording limit unit judges whether the recording mode set by the recording mode setting unit is au sable recording mode for recording according to the platen gap detected by the gap detector.

(11) The ink jet recording apparatus according to (9) or (10), wherein the recording limit unit judges whether the recording mode set by the recording mode setting unit is a usable recording mode for recording according to whether a border free print mode in which printing is performed up to borders of a recording sheet is set or not.

(12) The ink jet recording apparatus according to any one of (9) to (11) further comprising:

a recording mode switching unit for switching the recording mode to one of the usable recording modes when the recording mode set by the recording mode setting unit is not the usable recording mode.

(13) The ink jet recording apparatus according to any one of (9) to (12) further comprising:

a notice unit for notifying that the recording mode set by the recording mode setting unit is not the usable recording mode when the recording mode limit unit judges that the recording mode set by the recording mode setting unit is not the usable recording modes.

(14) The ink jet recording apparatus according to (13), wherein the notice unit notifies that the recording mode is not the usable recording mode by sending an error code to a host computer.

(15) The ink jet recording apparatus-according to any one of (9) to (14), wherein inks ejected respectively by the various kinds of drive signals generated by the drive signal generator are different in the minimum amount.

The present disclosure relates to the subject matter contained in Japanese patent application No. 2000-316256 (filed on Oct. 17, 2000), which is expressly incorporated herein by reference in its entirety.

DETAILED DESCRIPTION OF PREFERRED EMBODIMENTS

Figure 1:
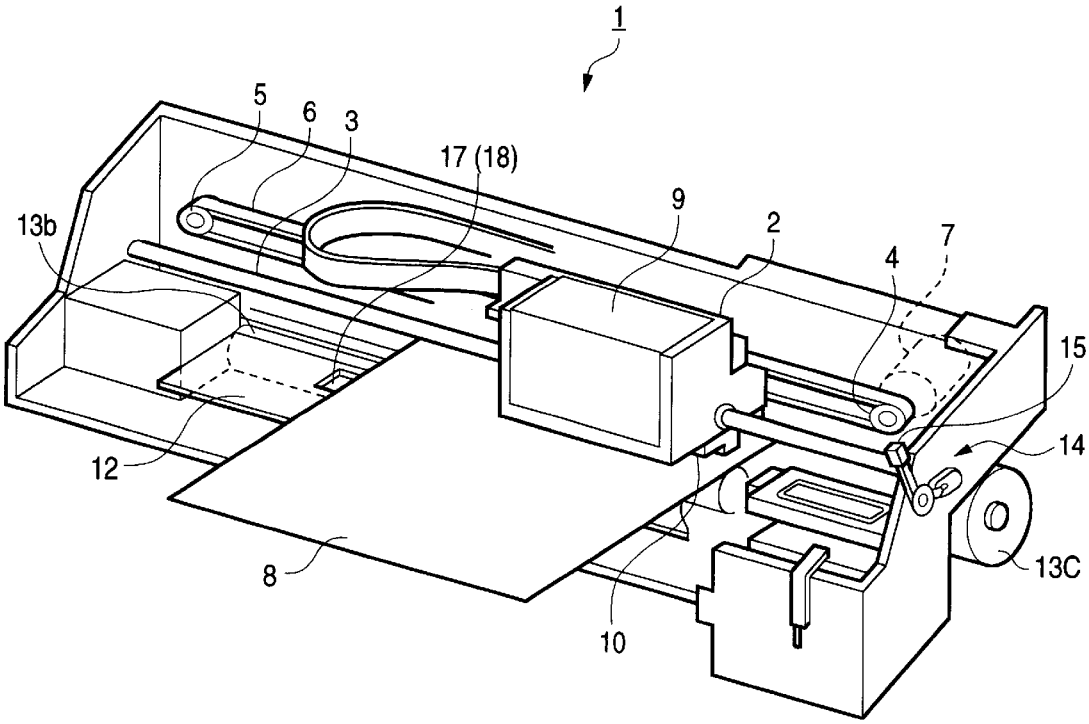
FIG. 1 is a perspective view of an ink jet printer.

An embodiment according to the present invention will be described below with reference to drawings. FIG. 1 is a perspective view or an ink jet printer that is typical of an ink jet recording apparatus. Firstly, the whole constitution will be described with reference to FIG. 1.

In an ink jet printer 1, a carriage 2 is movably attached to a guide shaft 3, and this carriage 2 is connected to a timing belt 6 laid between a drive pulley 4 and an idling pulley 5. The drive pulley 4 is connected to a rotational shaft of a pulse motor 7, and the carriage 2 is moved in the width direction (main scanning direction) of a recording sheet 8 by driving the pulse motor 7. An ink cartridge 9 is detachably attached to the upside of the carriage 2, and a recording head 10 is attached to the surface (lower surface) of the carriage opposed to the recording sheet 8. A platen 12 is arranged below the guide shaft 3 in parallel with the guide shaft 3.

Figure 2:
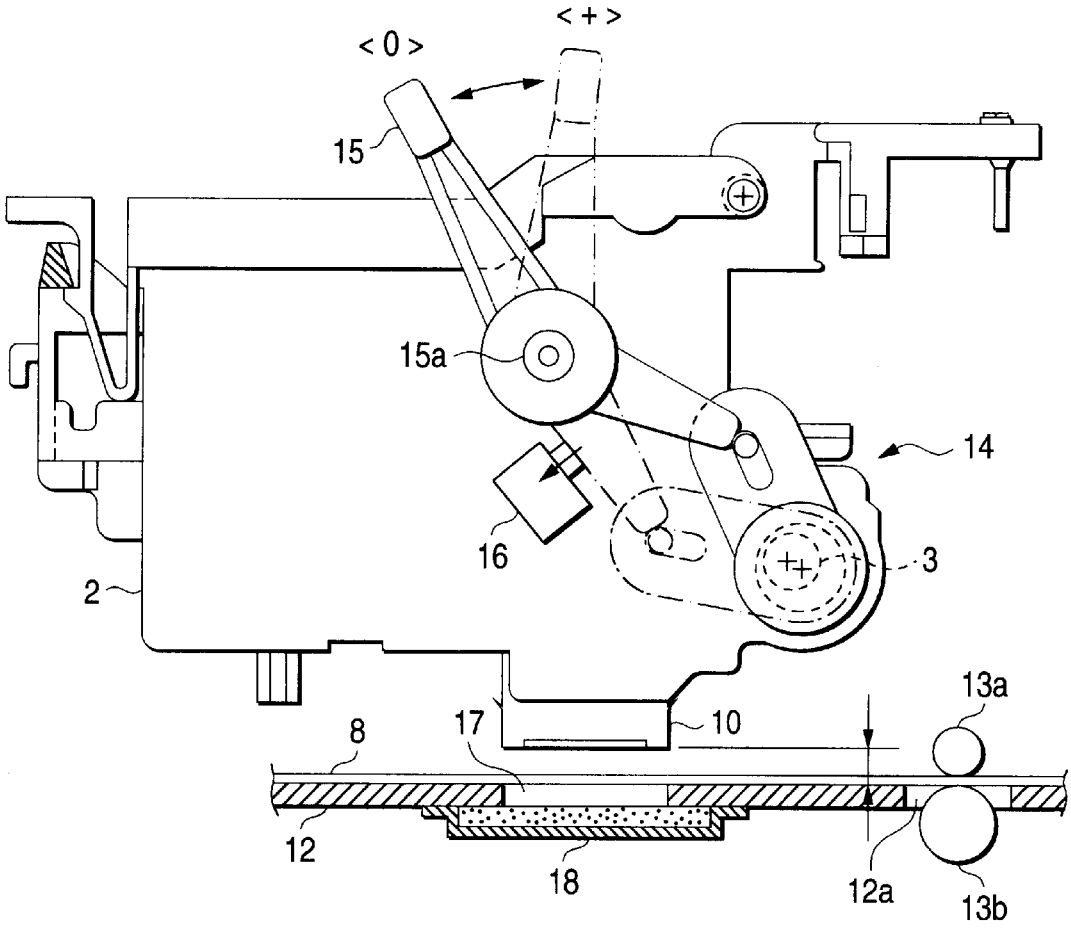
FIG. 2 is an enlarged side view of an adjustment section of a platen gap.

The platen 12 comprises a plate-shaped member for guiding the recording sheet 8. On the upstream side in the sheet feeding direction (corresponding to the sub-scanning direction) of this platen 12, as shown in FIG. 2, a pair of sheet feeding rollers 13*a*, 13*b* are arranged in a state where they face to a roller window 12*a*. These sheet feeding rollers 13*a*, 13*b* are rotated and driven by action of a sheet feeding motor 13*c*, and transport the recording sheet 8 in the sheet feeding direction.

A gap adjustment mechanism is provided at one end portion of the guide shaft 3. The gap adjustment mechanism in this embodiment is a mechanism for adjusting a gap (hereinafter referred to as a platen gap) from a nozzle orifice 33 (refer to FIG. 4) of the recording head 10 to the platen 12 by moving the recording head 10 up and down. As shown in FIG. 2, this gap adjustment mechanism comprises an eccentric cam 14 supporting the guide shaft 3 in an eccentric state in which the guide shaft 3 is out of a rotational center, an adjustment lever 15 coupled to the eccentric cam 14, and a platen gap detecting sensor 16 provided in a position corresponding to the moving range of the adjustment lever 15 in which the operation state of the detecting sensor is changed according to the position of the adjustment lever 15.

In this gap adjustment mechanism, the adjustment lever 15 is rotated about a supporting shaft 15*a*, thereby the eccentric cam 14 is rotated and the guide shaft 3 is moved up and down. With the up-and-down movement of this guide shaft 3, the carriage 2 is moved up and down, so that the platen gap is changed. For example, in case that the adjustment lever 15 is moved to a side <0>, as shown by a solid line in FIG. 2, the guide shaft 3 is moved downward. This state becomes a normal state in which b the carriage 2 and the recording head 10 (nozzle orifice 33) approach the platen 12. On the other hand, in case that the adjustment lever 15 is moved to a side <+>, as shown by a virtual line of a two-dot chain line, the guide shaft is moved upward. In this state, the recording head 10 (nozzle orifice 33) is more distant from the plate 12 than in the normal state, so that the platen gap is enlarged. In the following description, a state in which the platen gap is enlarged is taken as a "large gap" state.

In case of a comparatively thin recording sheet such as plain paper, the adjustment lever 15 is moved to the side <0> (thin paper side) thereby to set the platen gap in the normal state. On the other hand, in case of a comparatively thick recording sheet 8 such as board paper, the adjustment lever 15 is moved to the side <+> (thick paper side) and the guide shaft 3 is pulled up thereby to set the platen gap in the state of the large gap. By thus adjusting the platen gap, the gap from the nozzle orifice 33 to the recording surface of the recording sheet 8 is set in the predetermined range suitable for recording.

The platen gap detecting sensor 16 is a kind of the gap detector of the invention, and is constituted by a so-called micro-switch in this embodiment. When the adjustment lever 15 is moved to the side <+>, a switch of the platen gap detecting sensor 16 is brought into contact with the adjustment lever 15 and pushed on, so that the platen gap detecting sensor 16 becomes an ON-state. Further, when the adjustment lever 15 is moved from the side <+> to the side <0>, the contacting state of the switch with the adjustment lever 15 is released and the platen gap detecting sensor 16 is switched to an OFF-state. Accordingly, by watching the detection signals from this platen gap detecting sensor 16, whether the gap from the nozzle orifice 33 to the recording sheet 8 is in the normal state (state of the small gap) or the state of the large gap can be detected. In this embodiment, the detection signals from the platen gap detecting sensor 16 are output to a control section 46 (refer to FIG. 5), so that the control section 46 can perceive the platen gap.

Figure 3:
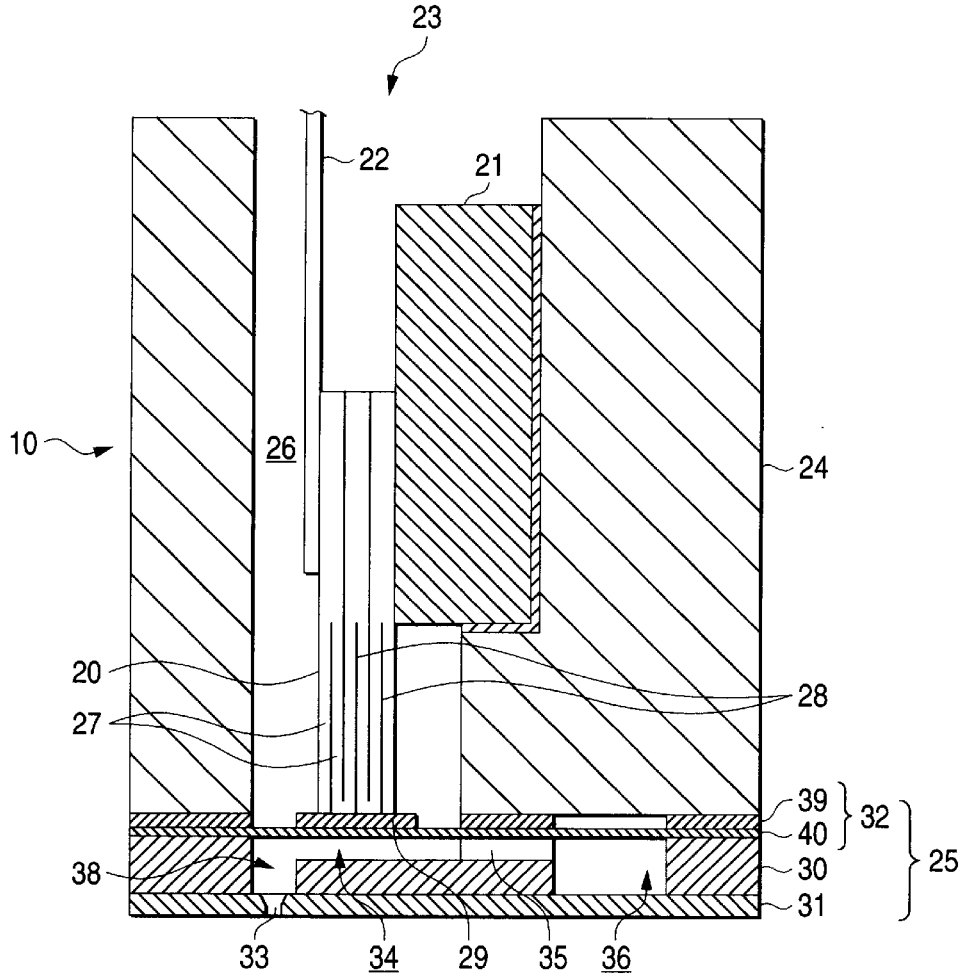
FIG. 3 is a sectional view for explaining the inner structure of a recording head.

Next, the structure of the recording head 10 will be described. As shown in FIG. 3, the illustrated recording head 10 includes a vibrator unit 23 in which a plurality of piezoelectric vibrators 20, a fixed plate 21 and a flexible cable 22 are united, a case 24 that can accommodate the vibrator unit 23 therein, and a flow passage unit 25 connected to a leading end surface of the case 24.

The case 24 is a block-like member made of synthetic resin, which forms a housing space 26 of which leading and rear ends are opened. In the housing space 26, the vibrator unit 23 is housed and fixed. This vibrator unit 23 is accommodated so that the comb teeth shaped leading end (namely, leading end surface) of the piezoelectric vibrator 20 is faced to the opening on the leading end side, and the fixed plate 21 is bonded to a wall surface of the housing space 26.

The piezoelectric element 20 is a kind of a pressure generating element, and also a kind of an electromechanical conversion element. This piezoelectric element 20 is formed in the shape of comb-teeth cut into needle-like pieces, and its base end portion is joined onto the fixed plate 21. The leading end surface of each of the piezoelectric vibrators 20 is brought into contact with and fixed to an island portion 29 of the flow passage unit 25. Further, the flexible cable 22 is electrically connected, at the base end side surface of the vibrator where is on the opposite side to the fixed plate 21, to each of the piezoelectric vibrators 20.

Figure 4:
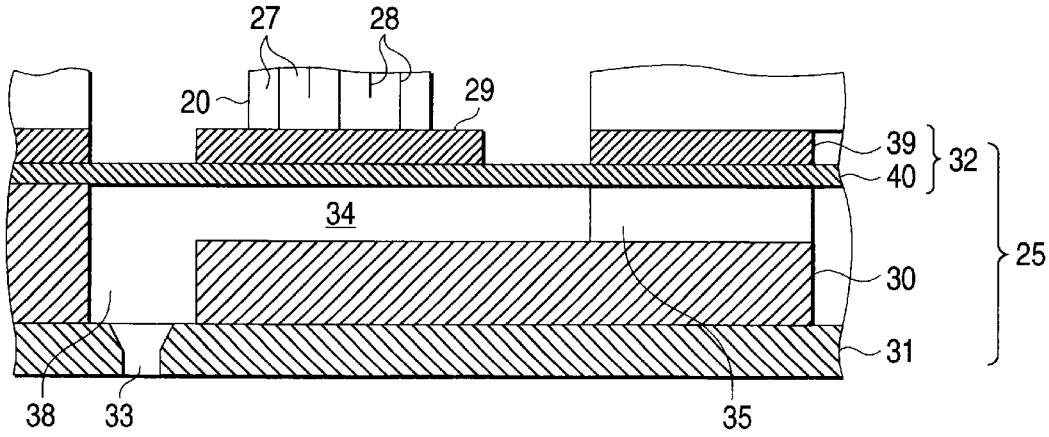
FIG. 4 is an enlarged sectional view of a flow passage unit of the recording head shown in FIG. 3.

As shown in FIG. 4, the flow passage 25 is constituted so that a nozzle plate 31 is arranged on one surface side of a flow passage forming substrate 30 and an elastic plate 32 is arranged on the other surface side thereof opposed to the nozzle plate, so as to enclose the flow passage forming substrate 30 therebetween.

The nozzle plate 31 is a thin plate made of stainless steel in which plural nozzle orifices 33 are formed in a line at a pitch corresponding to the dot forming density. In this embodiment, ninety-six nozzle orifices 33 are formed at a pitch of 180 dpi, and these nozzle orifices 33 constitute a nozzle line. A plurality of nozzle lines are formed so as to correspond to the kinds (for example, color) of ink which can be ejected therefrom.

The flow passage forming substrate 30 is a plate-like member, and forms a plurality of spaces, of which each functions as a pressure chamber 34 corresponding to each of the nozzle orifices 33 and is defined by partition walls, and space functioning as an ink supply port 35 and a common ink chamber 36. The flow passage forming substrate 30 is formed, for example, by etching a silicon wafer. The pressure chamber 34 is constituted by a flat recess chamber. In a position of the pressure chamber 34 where is most distant from the common ink chamber 36, a nozzle communicating port 38 that communicates with the nozzle orifice 33 and the pressure chamber 34 is provided by passing through the flow passage forming substrate 30 in the direction of thickness of the plate.

The elastic plate 32 serves both as a diaphragm portion for sealing one opening surface of the pressure chamber 34 and a compliance portion for sealing one opening surface of the common ink chamber 36, and has a double structure in which a resin film 40 such as PPS (polyphenylene sulfide) is laminated on a stainless steel plate 39. The island portion 29 is formed by annularly etching a part of the stainless steel plate 39 functioning as a diaphragm portion.

In the recording head 10 having the above constitution, the piezoelectric vibrator 20 is expanded in the longitudinal direction of the vibrator (i.e., in the vertical direction) by discharging, there by the island portion 29 is pressed on the nozzle plate 31 side, so that the resin film 40 constituting the diaphragm portion is deformed and the pressure chamber 34 is contracted. When the piezoelectric vibrator 20 is contracted in the longitudinal direction of the vibrator by charging, the pressure chamber 34 is expanded by elasticity of the resin film 40. Therefore, by controlling expansion and contraction of the pressure chamber 34, the ink pressure in the pressure chamber 34 changes and the ink droplet is ejected from the nozzle orifice 33.

In the thus constructed printer 1, by an activating instruction of the recording operation, the ink droplets are ejected from the recording head 10 in synchronization with the movement of the carriage 2 in the direction of paper width thereby to perform the main scanning, and the sheet feeding rollers 13*a*, 13*b* are rotated in cooperation with the reciprocating movement of the carriage 2 and the recording sheet 8 is moved in the sheet feeding direction thereby to perform the sub-scanning. As a result, images, characters and the like on the basis of the data to be printed are recorded on the recording sheet 8.

Further, this printer 1 can operates in a plurality of recording modes which are different in the correspondence of the gradation data and the amount of the ink droplet. For example, the printer can operate in a high-speed recording mode in which particular emphasis is put on acceleration of the recording speed, in a first high-resolution recording mode in which resolution of recording is higher than that in the high-speed recording mode, and in a second high-resolution recording mode in which resolution of recording is further higher than that in the first high-resolution recording mode.

Further, in this printer 1, the recording operation can be performed in a border free print mode in which printing is performed throughout all the area of the recording sheet 8. In this border free printing mode, the width of the main scanning is enlarged fully in the width direction or the recording sheet 6 to perform the printing throughout all the area in the width direction of the recording sheet 8. Further, also regarding front and back sides of the recording sheet 8, printing is performed fully up to the borders. In this recording operation, the print data in a range that is wider a little than the area of the recording sheet 8 is prepared, and the ink droplets are ejected up to the area over the four sides of the recording sheet. In order to prevent a stain with the ink droplets that have not landed on the recording sheet 8, an absorber window 17 is provided in a position of the platen 12 where corresponds to the four sides of the recording sheet 8, passing through the platen in the direction of the plate thickness. An absorber 18 is arranged on the rear surface side of the platen 12, and faced to this absorber window 17.

This absorber 18 is constituted by a member that can absorb ink and keep it therein. For example, a foam material such as a sponge or a polymer absorber is used preferably. The ink droplets ejected on the outside of the each border of the recording sheet 8 is absorbed and kept by the absorber 18.

Figure 5:
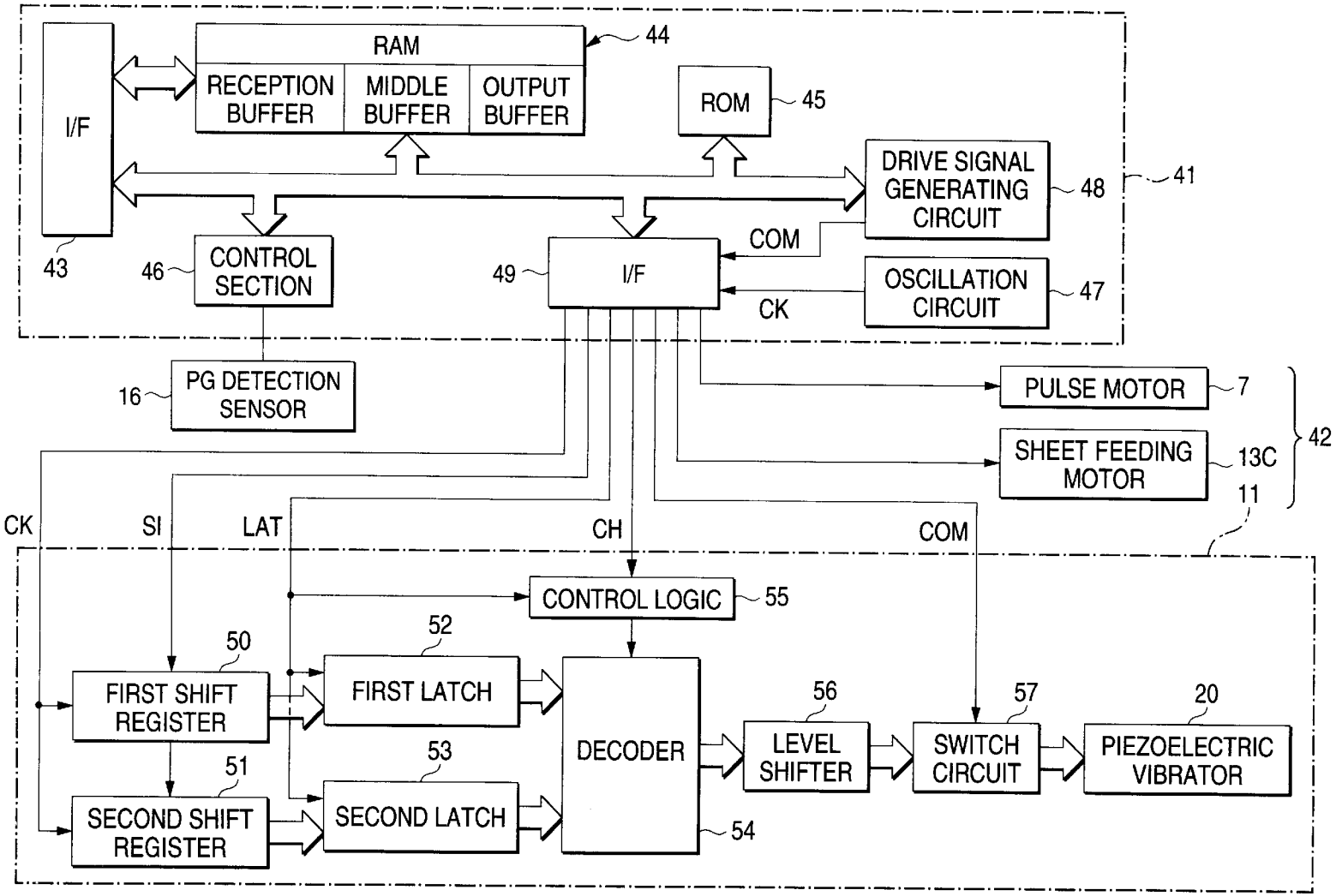
FIG. 5 is a block diagram for explaining the electrical constitution of the printer.

Next, the electric constitution of the printer 1 will be described. The illustrated printer, as shown in FIG. 5, has a printer controller 41 and a print engine 42.

The printer controller 41 comprises an interface 43 (hereinafter, referred to as an external I/F 43) for receiving print data from a host computer (not shown), a RAM 44 for storing various data, a ROM 45 for storing a control routine for various data processing, a control section 46 composed of a CPU, an oscillation circuit 47 for generating a clock signal (CK), a drive signal generating circuit 48 for generating a drive signal (COM) supplied to the recording head 10, and an interface 49 (hereinafter to as an internal I/F 49) for transmitting the printing data (SI) in which data to be printed is expanded into dots and drive signals to the print engine 42.

The external I/F 43 receives the print data comprising at least one of, for example, a character code, graphic function, and image data from the host computer or the like. Further, a control command (recording mode setting data) for specifying the recording mode, transmitted from the host computer, and a control command (border free print mode setting data) for specifying the border free print mode are also input through this external I/F 43. On the other hand, the external I/F 43 outputs a busy signal (BUSY) and an acknowledge signal (ACK) to the host computer. Further, in case that the recording mode on the basis or the recording mode setting data cannot be used due to setting of the platen gap and the border free print mode, an error code for notifying unfitness is transmitted through the external I/F 43 to the host computer.

The RAM 44 is used as a reception buffer, a middle buffer, an output buffer, a work memory (not shown), etc. In the reception buffer, the print data received by the external I/F 43 from the host computer is temporarily stored. In the middle buffer, middle code data converted into a middle code by the control section 46 is stored. In the output buffer, printing data (dot pattern data) of each dot is expanded. The ROM 45 stores therein various control routines executed by the control section 46, font data, graphic function, and various procedures.

The drive signal generating circuit 48 is a kind of a drive signal generator in the invention, and generates various kinds of drive signals corresponding to the recording modes. For example, the drive signal generating circuit 48 generates a drive signal including various kinds of drive pulses that are different in the volume of an ink droplet and a drive signal in which various kinds of drive pulses that are equal in the volume of an ink droplet are connected in series. The drive signal generating circuit 48 in this embodiment can generate three kinds of drive signals comprising a first drive signal VSD1 used in the high-speed recording mode, a second drive signal VSD2 used in the first high-resolution recording mode, and a third drive signal VSD3 used in the second high-resolution recording mode. These drive signals are different in the minimum amount of ink. Each of the drive signals will be described later in detail.

The control section 46 reads out the print data in the reception buffer, converts it into a middle code, and stores this middle code data in the middle buffer. Further, the control section 46 analyzes the middle code data read out of the middle buffer, and expands the middle code data into the above printing data with reference to the font data and graphic function in the ROM 45. This printing data is composed of gradation data of, for example, two bits.

This expanded printing data is stored in the output buffer. When the printing data corresponding to one line of the recording head 10 is obtained, the printing data (SI) for this one line is serially transmitted through the internal I/F 49 to the recording head 10. When the printing data for one line is transmitted from the output buffer, the contents in the middle buffer are deleted and the next conversion into a middle code is performed.

The control section 46 supplies a latch signal (LAT) and a channel signal (CH) through the internal I/F 49 to the recording head 10. These latch signals and channel signals specify a supply-start timing of the pulse signal constituting the drive signal (COM).

Further, the control section 46 functions also as a recording mode setting unit. On the basis of the recording mode setting data from the host computer, the control section 46 sets one recording mode from the above plurality of recording modes. Further, it functions also as a print mode setting unit. On the basis of the border free print mode setting data from the host computer, the control section 46 sets the border free print mode or the normal print mode (print mode with borders).

Further, the control section 46 functions also as a recording mode limiting unit. On the basis of the detection signal from the platen gap detecting sensor 16, the control section 36 grasps a platen gap, and limits usable recording modes to a part of three kinds of recording modes (high-speed recording mode, first high-resolution recording mode, and second high-resolution recording mode) according to the grasped platen gap. Further, also according to the existence of setting of the border free print mode, the control section 46 limits usable recording modes to a part of the three kinds of recording modes. The detailed operation of this recording mode limit unit will be described later.

The print engine 42 is constituted by an electric drive system 11 of the recording head 10, a pulse motor 7 for moving the carriage 2, and a sheet feeding motor 13*c*.

The electric drive system 11 of the recording head 10 includes a shift register circuit comprising a first shift register 50 and a second shift register 51, a latch circuit comprising a first latch circuit 52 and a second latch circuit 53, a decoder 54, a control logic 55, a level shifter 56, a switch circuit 57, and a piezoelectric vibrator 20. A plurality of the shift registers 50, 51, the circuits 52, 53, the decoders 54, the level shifters 56, the switch circuits 57, and the piezoelectric vibrators 20 are provided correspondingly to the respective nozzle orifices 33 of the recording head 10.

This recording head 10 ejects the ink droplets on the basis of the printing data (gradation data) from the printer controller 41. Namely, the printing data (SI) from the printer controller 41, in synchronization with the clock signal (CK) from the oscillation circuit 47, is serially transmitted through the internal I/F 49 to the first shift register 50 and the second shift register 51. The printing data from the printer controller 41 is a two-bit data, and represents four gradations comprising non-recording data, small dot data, middle dot data, and large dot data. In this embodiment, the non-recording data is gradation data (00), the small-dot data is gradation data (01), the middle-dot data is gradation data (10), and the large-dot data is gradation data (11).

This printing data is set for each dot, that is, for each nozzle orifice 33. Lower rank bit data (0-bit) regarding the entire nozzle orifices 33 are input to the first shift registers 50, and upper rank bit data (1-bit) regarding the entire nozzle orifices are input to the second shift registers 51. When the latch signals (LAT) from the printer controller 41 are input to the respective latch circuits 52, 53, the first latch circuits 52 latch the lower rank bit data of the printing data, and the second latch circuits 53 latch the upper rank bit data of the printing data.

The printing data latched by each of the latch circuits 52, 53 is input to the corresponding decoder 54. This decoder 54 translates the 2-bit printing data (gradation data) and generates the pulse selection data. This pulse selection data comprises the plural bits, and each bit corresponds to each pulse signal constituting the drive signal (COM). According to the contents [for example, (0), (1)] of each bit, supply or non-supply of the pulse signal to the piezoelectric vibrator 20 is selected. The supply control of the pulse signal will be described later. Further, timing signals from the control logic 55 are input to the respective decoders 54. This control logic 55 generates the timing signal on the basis of the latch signal (LAT) and the channel signal (CH).

The pulse selection data translated by each of the decoders 54 is input to the level shifter 56 in the order of the upper rank bit data each time the timing provided by the timing signal comes. For example, at the first timing in a print period, the uppermost rank bit data of the pulse selection data is input to the level shifter 56, and at the second timing, the second upper rank bit data of the pulse selection data is input to the level shifter 56.

This level shifter 56 functions as a voltage amplifier. In case that the pulse selection data is (1), the level shifter 56 outputs an electric signal of which the voltage is raised to a voltage by which the switch circuit 57 can driven, for example, to a voltage of about tens volts. The pulse selection data (1) in which the voltage has been raised by the level shifter 56 is supplied to the switch circuit 57. This switch circuit 57 supplies selectively the drive pulse included in the drive signal to the piezoelectric vibrator 20 on the basis of the pulse selection data. The drive signal (COM) from the drive signal generating circuit 48 is supplied to the input side of the switch circuit 57. The piezoelectric vibrator 20 is connected to the output side of the switch circuit 57.

The pulse selection data controls the operation of the switch circuit 57. For example, while the pulse selection data supplied to the switch circuit 57 is (1), the switch circuit 57 is in the On-state and the drive signal is supplied to the piezoelectric vibrator 20, so that the potential level of the piezoelectric vibrator 20 changes according to this drive signal. On the other hand, while the pulse selection data supplied to the switch circuit 57 is (0), the electric signal for operating the switch circuit 57 is not output from the level shifter 56, so that the switch circuit 57 is in the off-state and the drive signal is not supplied to the piezoelectric vibrator 20. And, while the pulse selection data is (0), the potential level of the piezoelectric vibrator 20 keeps the potential level immediately before the pulse selection data is switched to (0).

Figure 6:
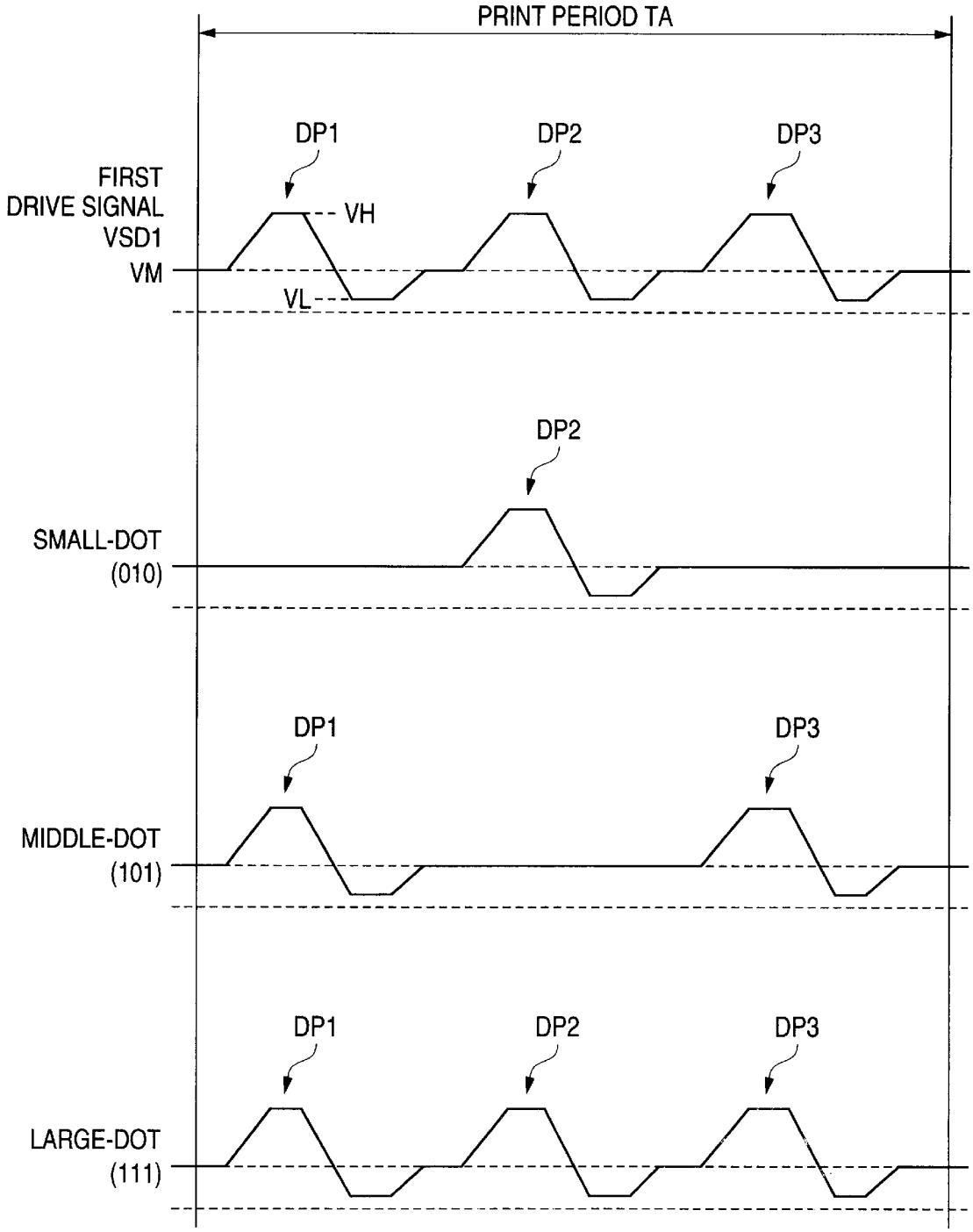
FIG. 6 is a waveform chart showing a first drive signal and drive pulses included in the first drive signal.
Figure 7:
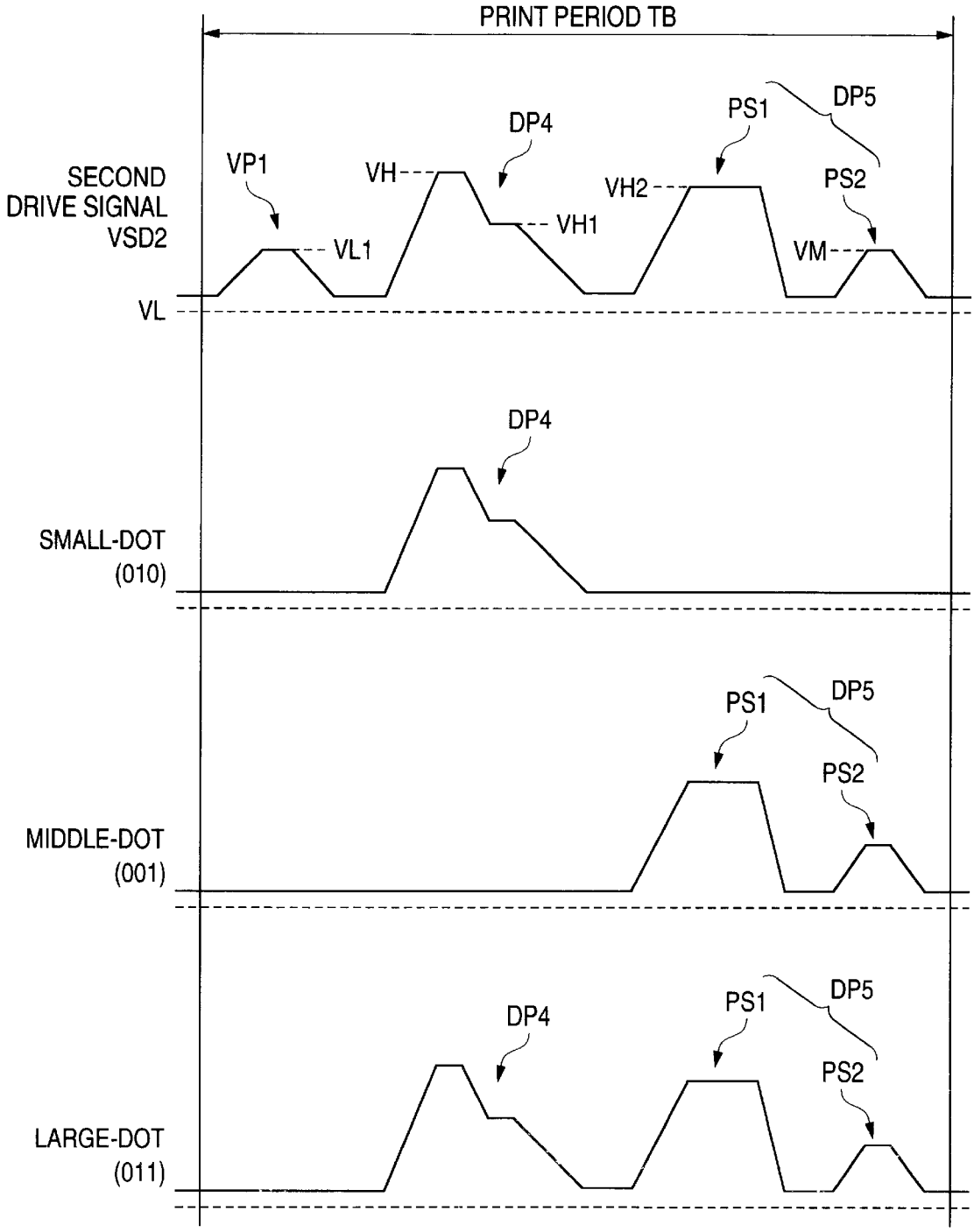
FIG. 7 is a waveform chart showing a second drive signal and drive pulses included in the second drive signal.
Figure 8:
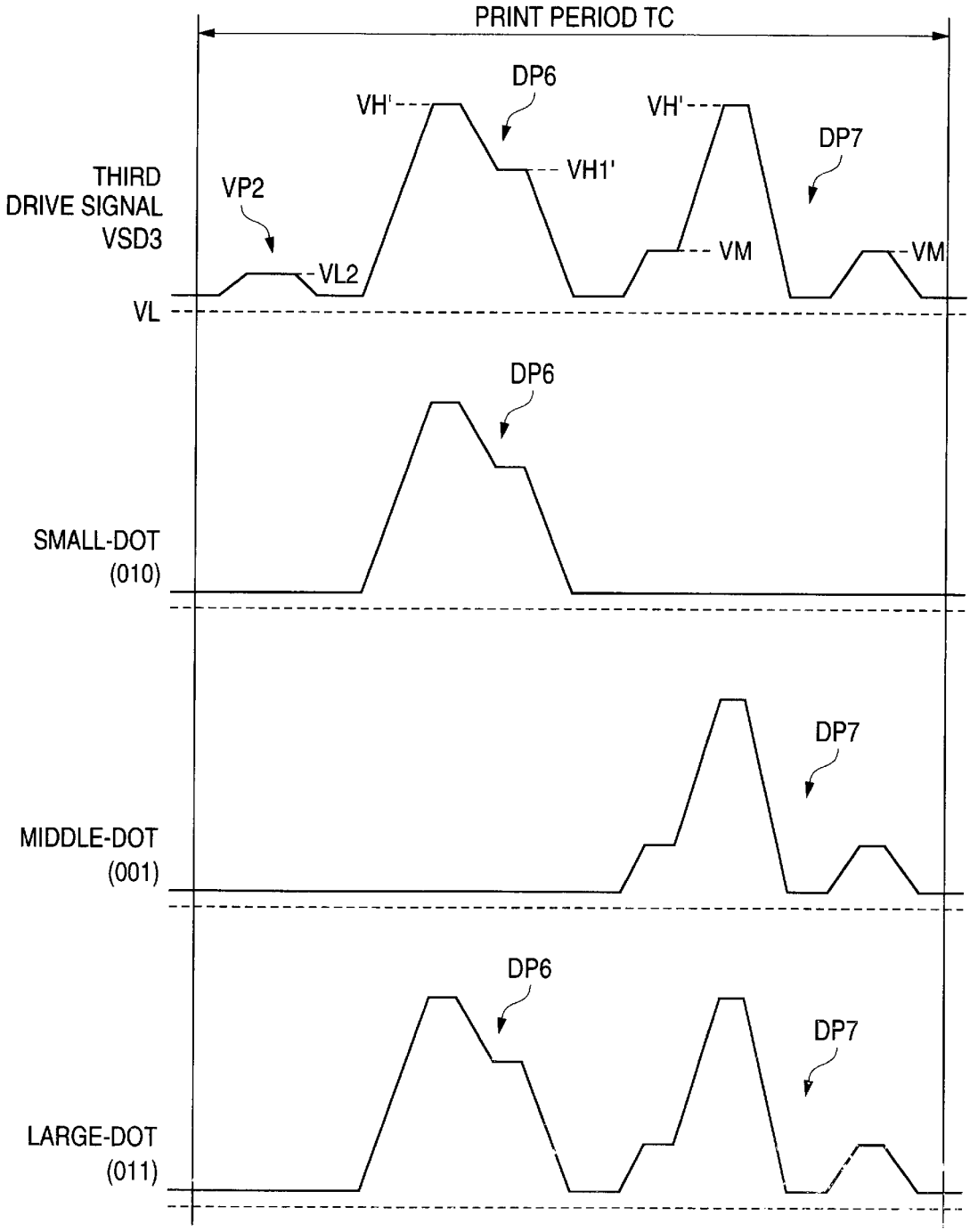
FIG. 8 is a waveform chart showing a third drive signal and drive pulses included in the third drive signal.

Next, the drive signal (COM) generated by the drive signal generating circuit 48 and the ejection control of the ink droplet by this drive signal will be described. This drive signal generating circuit 48 generates, according to the set recording mode, the various kinds of drive signals that are different in the amount of ejected ink though the printing data (gradation data) are the same. FIG. 6 is a waveform chart showing a first drive signal VSD1 used in the high-speed recording mode, and drive pulses DP1 to DP3 in this first drive signal VSD1. FIG. 7 is a waveform chart showing a second drive signal VSD2 used in the first high-resolution recording mode, and drive pulses VP1, DP4, and DP5 in this second drive signal VSD2. FIG. 8 is a waveform chart showing a third drive signal VSD3 used in the second high-resolution recording mode, and drive pulses VP2, DP6, and DP7 in this third drive signal VSD3.

Firstly, the first drive signal VSD1 will be described. As shown in FIG. 6, this first drive signal VSD1 includes the first drive pulse DP1, the second drive pulse DP2, and the third drive pulse DP3 in a print period TA in series, and is a signal that is produced repeatedly with the print period TA.

Any of these first drive pulse DP1, second drive pulse DP2, and third drive pulse DP3 have the same waveform. This waveform is constituted by connecting in order an expansion element in which the electrical potential is raised from a middle electrical potential VM to the highest electrical potential VH with such a gradient that the ink droplet is not ejected, an expansion hold element in which the highest electrical potential VH is kept for a predetermined time, an ejection element in which the electrical potential is rapidly lowered from the highest electrical potential VH to the lowest electrical potential VL, a vibration-control hold element in which the lowest electrical potential VL is kept for a predetermined time, and a vibration-control element in which the electrical potential is raised from the lowest electrical potential VL to the middle electrical potential VM. Each of these drive pulses DP1 to DP3 is a signal that can eject the ink droplet independently. Namely, when one drive pulse is supplied to the piezoelectric vibrator 20, the ink droplet of the volume by which the small dot can be formed is ejected from the nozzle orifice 33. The amount of the ink droplet ejected at this time is, for example, about 13.3 pL. Namely, this first drive signal VSD1 is a signal by which the ink droplets that are equal in the ink volume can be ejected plural times.

In the high-speed recording mode using this first drive signal VSD1, the gradation control is performed by increasing or decreasing the number of the drive pulses supplied to the piezoelectric vibrator 20. For example, by supplying one drive pulse, the small-dot recording is performed, by supplying two drive pulses, the middle-dot recording is performed, and by supplying three drive pulses, the large-dot recording is performed.

Accordingly, the decoder 54 generates 3-bit pulse selection data according to the non-recording printing data (gradation data 00), the small-dot printing data (gradation data 01), the middle-dot printing data (gradation data 10), and the large-dot printing data (gradation data 11). Each bit of this pulse selection data corresponds to each pulse signal. Namely, the uppermost rank bit of the pulse section data corresponds to the first drive pulse DP1, the second bit corresponds to the second drive pulse DP2, and the lowermost rank bit corresponds to the third drive pulse DP3. Therefore, the decoder 54 generates the pulse selection data (000) by translating the non-recording printing data, generates the pulse selection data (010) by translating the small-dot printing data, generates the pulse selection data (101) by translating the middle-dot printing data, and generates the pulse selection data (111) by translating the large-dot printing data.

Hereby, on the basis of the small-dot printing data, only the second drive pulse DP2 is supplied to the corresponding piezoelectric vibrator 20. Similarly, on the middle-dot printing data, the first drive pulse DP1 and the third drive pulse DP3 are supplied, and on the large-dot printing data, the first drive pulse DP1, the second drive pulse DP2, and the third drive pulse DP3 are continuously supplied. As a result, the ink droplet of about 13.3 pL is ejected once from the nozzle orifice 33 in response to the small-dot printing data, so that the small dot is formed on the recording sheet 8. The ink droplet of about 13.3 pL is continuously ejected twice from the nozzle orifice 33 in response to the middle-dot printing data, so that the middle dot by the ink droplet of about 26.6 pL in total is formed on the recording sheet 8. Similarly, the ink droplet of about 13.3 pL is continuously ejected three times from the nozzle orifice 33 in response to the large-dot printing data, so that and the large dot by the ink droplet of about 40 pL in total is formed on the recording sheet 8. Therefore, the minimum amount of the ink in this high-speed recording mode (first drive signal VSD1) is about 13.3 pL.

Next, the second drive signal VSD2 will be described. This second drive signal VSD2 is a signal including various kinds of drive pulses that are different in the amount of ink. Namely, as shown in FIG. 7, the second drive signal VSD2 includes a slight vibration pulse VP1 for vibrating slightly a meniscus, a small-dot drive pulse DP4 for ejecting a small-dot ink droplet, and a middle dot drive pulse DP5 for ejects a middle-dot ink droplet in a print period TB in series, and is a signal that is produced repeatedly with the print period TB.

The slight vibration pulse VP1 comprises a slight vibration expansion element in which the electrical potential is raised from the lowest electrical potential VL to a second lowest electrical potential VL1 that is higher a little than VL with such a comparatively gentle potential gradient that the ink droplet is not ejected, a slight vibration hold element in which the second lowest electrical potential VL1 is kept for a predetermined time, and a slight vibration contraction element in which the electrical potential is lowered with a comparatively gentle potential gradient from the second lowest electrical potential VL1 to the lowest electrical potential VL. When this slight vibration pulse VP1 is supplied to the piezoelectric vibrator 20, the pressure change that is comparatively gentle is produced in the pressure chamber 34, and the meniscus vibrates slightly due to this pressure change.

The small-dot drive pulse DP4 is constituted by a signal that connects in order an expansion element in which the electrical potential is raised from the lowest electrical potential VL to the highest electrical potential VH with a comparatively sharp gradient, an expansion hold element in which the highest electrical element in which the electrical potential is lowered from the highest electrical potential VH to the second highest electrical potential VH1 that is lower a little than this highest electrical potential VH with a comparatively sharp gradient, an ejection hold element in which the second highest electrical potential VH1 is kept for a very short time, and a vibration control element in which the electrical potential is lowered from the second highest electrical potential VH1 to the lowest electrical potential VL. When this small dot drive pulse DP4 is supplied to the piezoelectric vibrator 20, the ink droplet of the volume by which the small dot can be formed, for example, the ink droplet of about 5.5 pL is ejected from the nozzle orifice 33.

The middle-dot drive pulse DP includes an ejection pulse PS1 for ejecting the ink droplet, and a vibration-control pulse PS2 that is generated after this ejection pulse PS1 and suppresses the vibration of the meniscus after ink droplet ejection. The ejection pulse PS1 comprises an expansion element in which the electrical potential is raised from the lowest electrical potential VL to the third highest electrical potential VH2 with such a gradient that the ink droplet is not ejected, an expansion hold element in which the third highest electrical potential VH2 is kept for a predetermined time, and an ejection element in which the electrical potential is lowered from the third highest electrical potential VH2 to the lowest electrical potential VL with a comparatively sharp gradient. The third highest electrical potential VH2 is set to an electrical potential that is lower than the highest electrical potential VH and higher than the second highest electrical potential VH1. When this middle dot drive pulse DPS is supplied to the piezoelectric vibrator 20, the ink droplet of the volume by which the middle dot can be formed, for example, the ink droplet of about 11.5 pL is ejected from the nozzle orifice 33.

In the first high-resolution recording mode in which this second drive signal VSD2 is used, the small-dot recording is performed by supplying the small-dot drive pulse DP4 to the piezoelectric vibrator 20. Further, the middle-dot recording is performed by supplying the middle-dot drive pulse DP5 to the piezoelectric vibrator 20, and the large-dot recording is performed by supplying the small-dot drive pulse DP4 and the middle-dot drive pulse DP5 continuously. Namely, the decoder 54 generates the pulse selection data (100) by translating the non-recording printing data, generates the pulse selection data (010) by translating the small-dot printing data, generates the pulse selection data (001) by translating the middle-dot printing data, and generates the pulse selection data (011) by translating the large-dot printing data.

Hereby, on the basis of the non-recording printing data, the meniscus of the corresponding nozzle orifice 33 vibrates slightly. On the basis of the small-dot printing data, the ink droplet of about 5.5 pL is ejected from the corresponding nozzle orifice 33 so that the small dot is formed on the recording sheet 8. On the basis of the middle-dot printing data, the ink droplet of about 11.5 pL is ejected from the corresponding nozzle orifice 33 so that the middle dot is formed on the recording sheet 8. Further, on the basis of the large-dot printing data, the ink droplet of about 23 pL in total is ejected from the corresponding nozzle orifice 33 so that the large dot is formed on the recording sheet 8. Accordingly, the minimum amount of the ink in this first high-resolution recording mode (second drive signal VSD2) is about 5.5 pL.

Each of the large, middle, and small dots in this first high-resolution recording mode is smaller than each of the large, middle, and small dots in the first high-speed recording mode. Therefore, recording having the high resolution and high picture quality can be performed.

Next, the third drive signal VSD3 will be described. This third drive signal VSD3 is also a signal including various kinds of drive pulses that are different in the amount of ink. Namely, as shown in FIG. 8, the third drive signal VSD3 includes a slight vibration pulse VP2 that vibrates slightly a meniscus, a small-dot drive pulse DP6 that ejects a small-dot ink droplet, and a middle-dot drive pulse DP7 that ejects a middle-dot ink droplet in a print period TC in series, and it is a signal that is produced repeatedly with the print period TC.

The slight vibration pulse VP2 comprises a slight vibration expansion element in which the electrical potential is raised from the lowest electrical potential VL to the third lowest electrical potential VL2 that is higher a little than VL with such a comparatively gentle potential gradient that the ink droplet is not ejected, a slight vibration hold element in which the third lowest electrical potential VL2 is kept for a predetermined time, and a slight vibration contraction element in which the electrical potential is lowered with a comparatively gentle potential gradient from the third lowest electrical potential VL2 to the lowest electrical potential VL. When this slight vibration pulse VP2 is supplied to the piezoelectric vibrator 20, the pressure change that is comparatively gentle is produced in the pressure chamber 34, and the meniscus vibrates slightly due to this pressure change. The third lowest electrical potential VL2 in this slight vibration pulse VP2 is set to an electrical potential that is lower a little than the second lowest electrical potential VL1 of the slight vibration pulse VP1.

The small-dot drive pulse DP6 comprises a signal that connects in order an expansion element in which the electrical potential is raised from the lowest electrical potential VL to the highest electrical potential VH1 with a comparatively sharp gradient, an expansion hold element in which the highest electrical potential VH' is kept for a very short time, an ejection element in which the electrical potential is lowered from the highest electrical potential VH' to the second highest electrical potential VH1' that is lower a little than this highest electrical potential VH' with a comparatively sharp gradient, an ejection hold element in which the second highest electrical potential VH1' is kept for a very short time, and a vibration control element in which the electrical potential is lowered from the second highest electrical potential VH1' to the lowest electrical potential VL. When this small dot drive pulse DP6 is supplied to the piezoelectric vibrator 20, a very small amount of an ink droplet by which the small dot can be formed, for example, a super-minute ink droplet of about 2.0 pL is ejected from the nozzle orifice 33.

The middle dot drive pulse DP7 comprises a preliminary expansion element in which the electrical potential is raised from the lowest electrical potential VL to a middle electrical potential VM with such a constant gradient that the ink droplet is not ejected, a preliminary hold element in which the middle electrical potential VM is kept for a predetermined time, an expansion element in which the electrical potential is raised from the middle electrical potential VM to the highest electrical potential VH' with such a constant gradient that the ink droplet is not ejected, an expansion hold element in which the highest electrical potential VH is kept for a predetermined time, an ejection element in which the electrical potential is sharply lowered from the highest electrical potential VH' to the lowest electrical potential VL, a first vibration-control hold element in which the lowest electrical potential VL is kept for a predetermined time, a vibration-control element in which the electrical potential is raised from the lowest electrical potential VL to the middle electrical potential VM, a second vibration-control hold element in which the middle electrical potential VM is kept for a predetermined time, and a return element in which the electrical potential is lowered from the middle electrical potential VM to the lowest electrical potential VL. When this middle dot drive pulse DP7 is supplied to the piezoelectric vibrator 20, the ink droplet of the amount by which the middle dot can be formed, for example, the ink droplet of about 5.5 pL is ejected from the nozzle orifice 33.

In the second high-resolution recording mode in which this third drive signal VSD3 is used, the small-dot recording is performed by supplying the small-dot drive pulse DP6 to the piezoelectric vibrator 20. Further, the middle-dot recording is performed by supplying the middle-dot drive pulse DP7 to the piezoelectric vibrator 20, and the large-dot recording is performed by supplying the small-dot drive pulse DP6 and the middle-dot drive pulse DP7 continuously. Namely, the decoder 54 generates the pulse selection data (100) by translating the non-recording printing data, generates the pulse selection data (010) by translating the small-dot printing data (gradation data 01), generates the pulse selection data (001) by translating the middle-dot printing data (gradation data 10), and generates the pulse selection data (011) by translating the large-dot printing data (gradation data 11).

Hereby, on the basis of the non-recording printing data, the meniscus of the corresponding nozzle orifice 33 vibrates slightly. On the basis of the small-dot printing data, the super-minute ink droplet of about 2.0 pL is ejected from the corresponding nozzle orifice 33 so that the small dot is formed on the recording sheet 8. Similarly, on the basis of the middle-dot printing data, the ink droplet of about 5.5 pL is ejected from the corresponding nozzle orifice 33 so that the middle dot is formed on the recording sheet 8. Further, on the basis of the large-dot printing data, the ink droplet of about 11.5 pL in total is ejected from the corresponding nozzle orifice 33 so that the large dot is formed on the recording sheet 8. Accordingly, the minimum amount of the ink in this second high-resolution recording mode (third drive signal VSD3) is about 2.0 pL.

Each of the large, middle, and small dots in this second high-resolution recording mode is smaller than each of the large, middle, and small dots in the first high-speed recording mode. Therefore, recording having the higher resolution and higher picture quality can be performed.

Next, the operation of this printer 1 will be described.

This printer 1 starts its operation on reception of the print data and control command sent from the host computer. Namely, when the printer receives these print data and control command, the control section 46 (recording mode setting unit) sets one recording mode from the plurality of recording modes on the basis of the control command regarding the recording mode (recording mode setting data). For example, one recording mode is set from the high-speed recording mode, the first high-resolution recording mode, and the second high-resolution recording mode. Further, the control section 46 (printer mode setting unit) sets the print mode on the basis of the control command regarding the print mode (border free print mode setting data). Namely, either the normal print mode in which print with borders is performed or the border free print mode in which print without borders is performed is set.

When the recording mode and the print mode have been set, the control section 46 (recording mode data output unit) outputs the control data (recording mode data) to the drive signal generation circuit 48 and the decoder 54.

On the basis of this control data, the drive signal generating circuit 48 sets the state where the drive signal according to the recording mode can be generated. For example, on reception of the control data indicating that the high-speed recording mode has been set, the drive signal generating circuit 48 sets the state where the first drive signal VSD1 (FIG. 6) can be generated; on reception of the control data indicating that the first high-resolution recording mode has been set, the drive signal generating circuit 48 sets the state where the second drive signal VSD2 (FIG. 7) can be generated; and on reception of the control data indicating that the second high-resolution recording mode has been set, the drive signal generating circuit 48 sets the state where the third drive signal VSD3 (FIG. 8) can be generated.

Further, the decoder 54 sets the combination of the printing data (gradation data) and the pulse selection data. For example, the decoder 54 selects the table data of the recording mode set on the basis of the control data from the control section 46 on the basis of table data in which the combination of the printing data and the pulse section data is determined in each recording mode.

When the recording mode has been set, the printer 1 performs the recording operation in the set recording mode. Here, in this embodiment, before the recording operation, the control section 46 (recording mode limit unit) performs judgment according to the detected platen gap and the set print mode, and limits usable recording modes to a part of the three kinds of recording modes if necessary.

Namely, regarding the platen gap, in case that the gap is in the normal state (in the state of the small gap), the recording can be performed in any of the high-speed recording mode, the first high-resolution recording node, and the second high-resolution recording mode. In case that the gap is in the state of the large gap, though the recording can be performed in the high-speed recording mode and the first high-resolution recording mode, the control section 46 limits the recording so that the recording cannot be performed in the second high-resolution recording mode. In other words, in the state of the small gap, the first drive signal VSD1, the second drive signal VSD2 and the third drive signal VSD3, that is, all the drive signals that the drive signal generating circuit 48 can generate can be used. On the other hand, in the state of the large gap, though the first drive signal VSD1 and the second drive signal VSD2 can be used, the third drive signal VSD3 cannot be used.

This control is performed in order to prevent the combination of the platen gap and the used recording mode by which the ink droplet becomes readily misty. For example, this control is performed in order to prevent the small-dot ink droplet in the second high-resolution recording mode, that is, the super-minute ink droplet of about 2 pL from becoming misty.

Figures 9, 10:
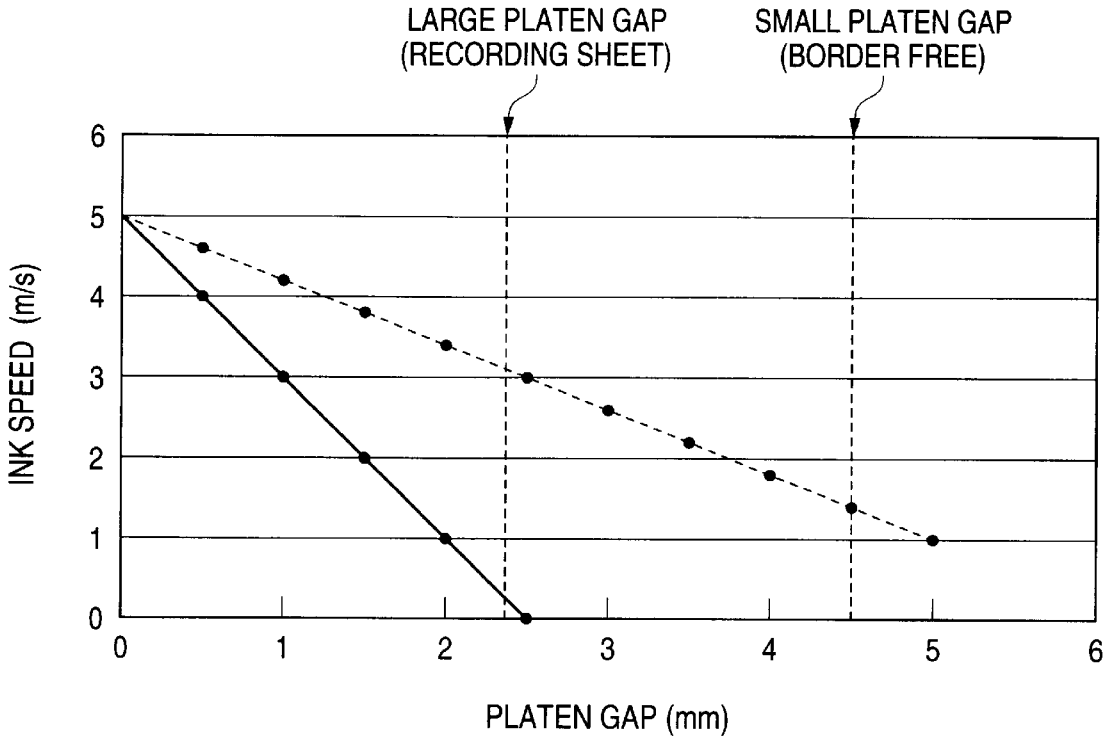
FIG. 9 is a characteristic graph showing relationship between jetting speed and flying distance of an ink droplet.
FIG. 10 is an explanatory view of usable recording modes.

This phenomenon is described with reference to FIG. 9. FIG. 9 is a characteristic graph showing relationship between jetting speed of an ink droplet and flying distance (platen gap) of the ink droplet; a vertical axis shows the jetting speed of the ink droplet and a horizontal axis shows the flying distance. In FIG. 9, a solid line shows relationship between jetting speed and the flying speed of a super-minute ink droplet (2 pL) in the third drive signal VSD3, and a dotted line shows relationship between the jetting speed and the flying speed of a minute ink droplet (5.5 pL) in the second drive signal VSD2.

This super-minute ink droplet receives a great influence of viscous resistance of air, so that the lowering rate of the speed in relation to the flying distance is large.

As shown in FIG. 9, in case of the super-minute ink droplet of about 2 pL, the jetting speed becomes 0 m/s at the flying distance of 2.5 mm. In state of the large gap, as shown in FIG. 10, since the platen gap is 2.3 mm, the jetting speed becomes 0 m/s just before the super-minute ink droplet lands. Therefore, in the state of the large gap, since there is a possibility that the super-minute ink droplet can not lands on the recording sheet 8 and becomes misty, it is difficult to record the image, etc.

Accordingly, in this embodiment, in the state of the large gap, by limiting the recording so that the recording in the second high-resolution recording mode cannot be performed, it is surely prevented that the super-minute ink droplet becomes misty.

On the other hand, in case of the minute ink droplet of about 5.5 pL, the jetting speed is about 3 m/s at the flying distance of 2.3 mm. Therefore, the ink droplet surely lands on the recording sheet 8.

On the other hand, regarding the print mode, in case that the normal print mode (print mode with borders) is set, the recording can be performed in any of the high-speed recording mode, the first high-resolution recording mode, and the second high-resolution recording mode. In case that the border free print mode is set, though the recording can be performed in the high-speed recording mode and the first high-resolution recording mode, the control section 46 limits the recording so that the recording in the second high-resolution recording mode cannot be performed. In other words, in the normal mode, the first drive signal VSD1, the second drive signal VSD2 and the third drive signal VSD3, that is, all the drive signals that the drive signal generating circuit 48 can generate can be used. On the other hand, in the border free print mode, though the first drive signal VSD1 and the second drive signal VSD2 can be used, the third drive signal VSD3 cannot be used.

This control is performed in order to prevent the super-minute ink droplets ejected outside the borders of the recording sheet 8 from becoming misty. Namely, in this border free print mode, the ink droplets are ejected also outside the borders of the recording sheet 8, and these ink droplets are absorbed by the absorber 18 through the absorber window 17. Here, since this absorber 18 is provided on the rear surface of the platen 12, it is necessary to jet the ink droplet by the distance that is sum of the plate thickness of the platen 12 and the platen gap in order to cause the ink droplet to be absorbed by the absorber 18. However, in the super-minute ink droplet, the lowering rate of the jetting speed is large due to the viscous resistance of air, and in case of the long flying distance, there is fear that the ink droplet cannot lands on the absorber 18 due to a shortage of speed. Therefore, in this embodiment, in the border free recording mode in which the ink droplet is ejected also outside the four sides of the recording sheet 8, by limiting the recording so that the recording in the second high-resolution recording mode cannot be performed, it is surely prevented that the super-minute ink droplet becomes misty.

That is, as shown in FIG. 10, in state of the small gap, the distance from the nozzle orifice 33 to the surface of the absorber is 4.5 mm. Therefore, as shown in FIG. 9, when the recording is executed with the third drive signal VSD3 (the second high-resolution recording mode), the flying speed becomes 0 m/s before the super-minute ink droplet of about 2 pL lands on the absorber 18, specifically at 2.5 mm from the nozzle orifice 33. Accordingly, since it is difficult to collect the super-minute ink droplet by the absorber 18, it is a fear that the super-minute ink droplet becomes misty.

Accordingly, in this embodiment, in the border free print mode in which the ink droplets are ejected also outside the borders of the recording sheets 8, by limiting the recording so that the recording in the second high-resolution recording mode cannot be performed, it is surely prevented that the super-minute ink droplet becomes misty.

In this embodiment, the judgment on the basis of the platen gap and the judgment on the basis of the print mode are together performed, so that the usable recording modes are selected as shown in FIG. 10. Namely, in case that the print mode with borders is set in the state of the small gap, the recording can be performed in each of the high-speed recording mode, the first high-resolution recording mode, and the second high-resolution recording mode. In case that the border free print mode is set in the state of the small gap, though the recording can be performed in the high-speed recording mode and the first high-resolution recording mode, the recording cannot be performed in the second high-resolution recording mode. In case that the print mode with borders is set in the state of the large gap, and in case that the border free print mode is set in the state of the large gap, though the recording can be performed in the high-speed recording mode and the first high-resolution recording mode, the recording cannot be performed in the second high-resolution recording mode.

Next, whether the recording mode set by the control command from the host computer is an unusable recording mode is judged according to the judgment on the basis of the platen gap and the print mode. In case that the set recording mode is judged as an unusable recording mode, the control section 46 (notice unit) output the alert representing that the recording mode is unsuitable. This alert is performed, for example, by displaying a message on a display of the host computer. In this case, the control section 46 sends an error code representing that the recording mode is unsuitable to the host computer. Then, the host computer receives this error code thereby to display the message on the display.

When the control section 46 has output the alert, the setting of the printer 1 is changed to a record setting which can be executed. This change of the setting is performed by any of change of the recording mode, change of the platen gap, and change of the print mode.

In case that the second high-resolution recording mode specified by the control command has been judged as unsuitable since the border free print mode has been together set, the recording mode is changed to the first high-resolution recording mode, thereby the recording can be performed in the border free print mode. In this setting-change operation, the control section 46 functions as a recording mode switching unit. And, the control section 46, according to the change of the recording mode, outputs the control signal to the drive signal generating circuit 48, and switches the drive signal to a drive signal to be used in recording.

In case that the second high-resolution recording mode specified by the control command has been judged as unsuitable since the platen gap is in the state of the large gap, the platen gap is changed to the normal state (the state of the small gap), thereby the recording can be performed in the second high-resolution recording mode.

In case that the border free print mode specified by the control command has been judged as unfitness since the second high-resolution recording mode has been together set, the recording mode is changed to the print mode with boarders, thereby the recording can be performed in the second high-resolution recording mode. In this case, the control section 46 functions as a print mode switching unit, and switches the border free print mode specified by the control command to the print mode with edges.

In this embodiment, the constitution is adopted, which causes the user of the printer 1 to selects switching of the recording mode, switching of the platen gap, or switching of the print mode after outputting of the alert. Hereby, the setting of the printer is changed to a setting which is fit for the desire of the user thereby to improve the convenience of use.

After the setting of the printer 1 was thus changed, the recording on the recording sheet 8 is performed under the set recording mode and print mode.

Figure 11:
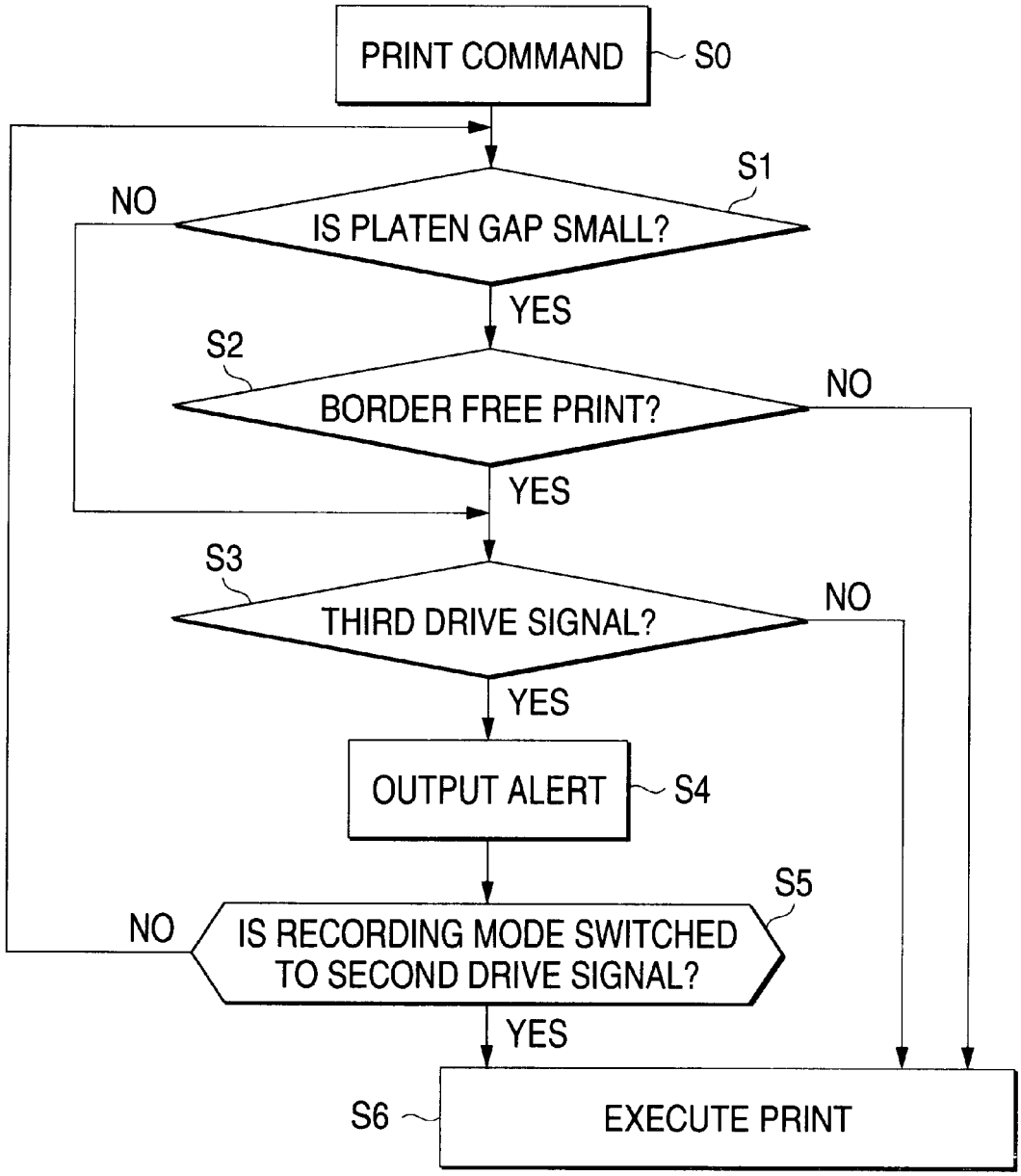
FIG. 11 is a flowchart of a control operation.

Next, with reference to a flowchart of FIG. 11, procedures of the judging operation on the basis of the above platen gap and print mode, and the switching operation of the recording mode will be described.

When the control section receives a print command sent (print data and control data) from the host computer [S0], the control section judges a setting value of the platen gap on the basis of the detection signal from the platen gap detecting sensor 16 [S1].

Here, in case of the small gap [S1, YES], the control section judges whether the border free print mode is selected on the basis of the control command [S2]. In case that the print mode with borders is selected [S2, NO], the control section receives the present operation condition and executes printing by the usual control procedure [S6]. On the other hand, in case that the border free print mode is selected [S2, YES], or in case of the large gap [S1, NO], the control section judges whether the second high-resolution recording mode by the third drive signal VSD3 is selected [S3].

Here, in case that the third drive signal VSD3 is not selected [S3, NO], the control section receives the present operation condition and executes printing by the usual control procedure [S6]. On the other hand, in case that the third drive signal VSD3 is selected, that is, in case that the second high-resolution recording mode is selected [S3, YES], the control section outputs the error code for outputting the alert to the host computer [S4] and waits.

The host computer that has received this error code displays the alert on the display. This alert is, for example, as follows: [IN THE PRESENT RECORDING MODE, THE INSIDE OF A PRINTER AND A RECORDING SHEET WILL BE CONTAMINATED.] [PLEASE SWITCH A RECORDING MODE TO A FIRST HIGH-RESOLUTION RECORDING MODE. OR, PLEASE MAKE A PLATEN GAP SMALL.]

During the above waiting, the control section monitors the control command from the host computer and the detection signal from the platen gap detecting sensor 16. When the recording mode is switched to the first high-resolution recording mode and the second drive signal VSD2 is selected [S5, YES], the control section receives the present operation condition and executes printing by the usual control procedure [S6]. Or, even if the recording mode is not switched to the second drive signal VSD2, [S5, NO], if the platen gap is switched to the small-gap state, and the print mode with edges is set [S1, YES] [S2, NO], the control section receives the present operation condition and executes printing by the usual control procedure [S6].

Figure 12:
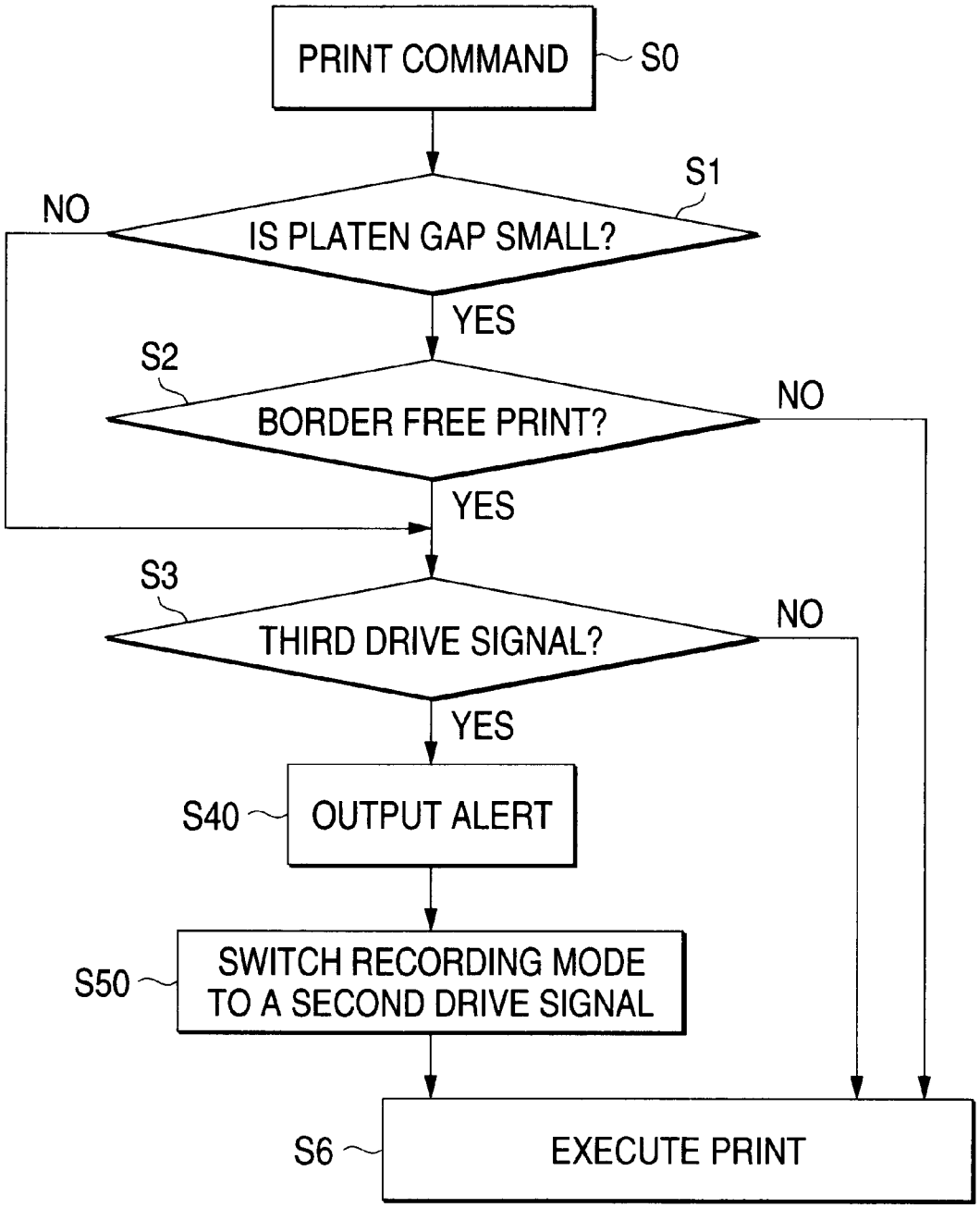
FIG. 12 is another flowchart of the control operation.

Regarding the above procedure, as shown in FIG. 12, the setting may be automatically changed. For example, in the step S3, in case that the second high-resolution recording mode is selected, the control section outputs the notice alert [S40], and switches the recording mode 6 to the first high-resolution recording mode (drive signal VSD2) automatically [S50].

The invention is not limited to the above embodiment, but various changes may be made based on the scope of patent claims.

In the above embodiment, three recording modes comprising the high-speed recording mode, the first-resolution recording mode, and the second high-resolution recording mode can be used, and in case that the platen gap is in the state of the large gap, the recording modes to be used are limited to the two recording modes comprising the high-speed recording mode and the first-resolution recording mode. However, for example, the number of kinds of the recording modes may be two or more, and the number of the recording modes to be limited may be at least one kind.

Further, in the above embodiment, the gap detector is so constituted that the positional relation between the recording head 10 and the platen 12 is grasped according to the rotational angle of the adjustment lever 15 and the platen gap is indirectly detected on the basis of this positional relation. However, the invention is not limited to this constitution. For example, the platen gap may be directly detected and the gap from the nozzle surface to the surface of the recording sheet may be detected. Further, the yap may be indirectly detected on the basis of the positions of the movable members such as the lever 15, the carriage 2, and the recording head 10, or may be directly detected by a sensor.

Regarding the gap adjustment mechanism, in the above embodiment, the constitution in which the gap can be switched to the two states comprising the large gap state and the usual state (the small gap state) is employed for the description. However, the invention is not limited to this. For example, the gap adjustment mechanism may be composed of a mechanism that can adjust the platen gap to plural ranks of three or more. Further, the gap adjustment mechanism may comprise a mechanism that moves the platen 12 up and down.

Further, in the above embodiment, on the basis of the control command from the host computer, the recording mode is set. However, a mode setting switch for setting a recording mode may be provided to the printer 1, and the recording mode may be set by the operation of this mode setting switch.

Further, regarding the pressure generating element, in the above embodiment, the piezoelectric vibrator 20 of the longitudinal vibration mode is indicated. However, a piezoelectric vibrator of a deflective vibration mode may be used in place of this piezoelectric vibrator 20. This piezoelectric vibrator of the deflective vibration mode contracts by charge in a direction perpendicular to an electric field, so that the contraction deformation contracts the pressure chamber 34, and the expansion deformation by discharge expands the pressure chamber 34. Further, the electromechanical conversion element is not limited to these piezoelectric vibrators, but may be a magnetic distortion element. Further, the pressure generating element is not limited to the electromechanical conversion element, but maybe a heat generating element. A recording head using the heat generating element is, for example, so constituted that ink around the heat generating element is boiled by heating the heat generating element rapidly, and ink in the pressure chamber is pressurized by air bubbles produced by this boil thereby to eject the ink droplet from the nozzle orifice. This invention can be applied also to a recording apparatus provided with the recording head having this constitution.

Further, regarding the above host computer, this host computer may be connected to the recording apparatus such as the printer 1 or the plotter through a communication network, and may be connected: directly to the recording apparatus. Further, in a recording apparatus having a data display such as a liquid crystal display and a LED display, the notice unit may be composed of the data display and the control section 46.

As described above, according to the invention, there are provided the gap detector for detecting the platen gap from the nozzle orifice, and the recording mode limit unit that limits the usable recording modes to a part of the plurality of recording modes according to the platen gap detected by the gap detector. Therefore, in case that the combination of the platen gap and the recording mode set by the recording mode setting unit is unsuitable, it is possible to prevent the recording from being performed in this unsuitable combination. For this reason, it is possible to previously prevent the super-minute ink droplet from becoming misty. Accordingly, the disadvantage such as a stain due to the ink mist in the recording apparatus can be prevented.

Further, there is provided the recording mode limit unit, which limits the usable recording modes to a part of the plural recording modes at the setting time of the border free print mode in which printing is performed up to the borders of the recording sheet. Therefore, even if the combination of the border free print mode and the recording mode set by the recording mode setting unit is unsuitable, it is possible to prevent the recording from being performed in this unfit combination. For this reason, it is possible to previously prevent the super-minute ink droplet from becoming misty. Accordingly, the disadvantage such as a stain due to the ink mist in the recording apparatus can be prevented.

Further, there is provided the recording mode switching unit, which switches the recording mode to be used to one of the usable recording modes limited by the recording mode limit unit in case that the recording mode limit unit judges that the recording mode set by the recording mode setting unit is not the usable recording mode. Therefore, even if the recording mode set by the recording mode setting unit makes the unsuitable combination, the recording mode can be switched to a recording mode that can prevent the ink droplet from becoming misty. For this reason; such the disadvantage that the super-minute ink droplet becomes misty can be surely prevented. Further, since the recording mode is switched on the apparatus side, the load on the user is reduced. Therefore, the convenience of use can be improved.

In case that the notice unit that notifies the unfitness recording mode when the recording mode limit unit judges that the recording mode set by the recording mode setting unit is not a usable recording mode, it is possible to request reset of the combination, so that the setting can be changed to the setting which is fit user's desire. Therefore, the convenience of use can be improved.

Further, in case that the various kinds of the drive signals generated by the drive signal generator are taken as the signals that are different in the minimum amount of ink, since the minimum amount of the ink droplet firstly becomes misty, the easiness to become misty changes stepwise. Since this minimum amount of ink specifies the resolution of the recording image, by using the drive signal of the minimum amount of ink in which the ink does not become misty it is possible to prevent the image quality from lowering after switching the recording mode.

What is claimed is:

1. An ink jet recording apparatus comprising:

a recording head for ejecting an ink droplet from a nozzle orifice according to supply of a drive pulse to a pressure generating element;

a recording mode setting unit for setting a recording mode from a plurality of recording modes that are different in a correspondence of gradation data and amount of ink;

a drive signal generator which can generate various kinds of drive signals including drive pulses according to the recording mode, wherein the drive signal generator generates a drive signal according to the recording mode set by the recording mode setting unit, and the drive pulses extracted from the generated drive signal are supplied to the pressure generating element;

a gap detector for detecting a platen gap from the nozzle orifice; and a recording mode limit unit for limiting usable recording modes to a subset of the plurality of recording modes according to the platen gap detected by the gap detector.

2. The ink jet recording apparatus according to claim 1 further comprising:

a recording mode switching unit for switching the recording mode to one of usable recording modes judged by the recording mode limit unit when the recording mode set by the recording mode setting unit is not the usable recording mode.

3. The ink jet recording apparatus according to claim 1 further comprising:

a notice unit for notifying that the recording mode set by the recording mode setting unit is not suitable when the recording mode limit unit judges that the recording mode set by the recording mode setting unit is not suitable.

4. The ink jet recording apparatus according to claim 3, wherein the notice unit notifies that the recording mode is not suitable by sending an error code to a host computer.

5. The ink jet recording apparatus according to claim 1, wherein inks ejected respectively by the various kinds of drive signals generated by the drive signal generator are different in the minimum amount.

6. The ink jet recording apparatus according to claim 5, wherein the recording mode limit unit limits drive signals to be used in the usable recording mode.

7. The ink jet recording apparatus according to claim 1, wherein the recording mode limit unit limits the usable recording modes to a part of the plurality of recording modes when a border free print mode in which printing is performed up to borders of a recording sheet is set.

8. The ink jet recording apparatus according to claim 1, wherein plurality of recording modes are different in a minimum amount of ejected ink.

9. An ink jet recording apparatus comprising:

a recording head for ejecting an ink droplet from a nozzle orifice according to supply of a drive pulse to a pressure generating element;

a recording mode setting unit for setting a recording mode from a plurality of recording modes that are different in a correspondence of gradation data and amount of ink;

a drive signal generator which can generate various kinds of drive signals including drive pulses according to the recording mode, wherein the drive signal generator generates a drive signal according to the recording mode set by the recording mode setting unit, and the drive pulses extracted from the generated drive signal are supplied to the pressure generating element;

a recording mode limit unit for limiting usable recording modes to a subset of the plurality of recording modes when a border free print mode in which printing is performed up to borders of a recording sheet is set.

10. The ink jet recording apparatus according to claim 9 further comprising:

a recording mode switching unit for switching the recording mode to one of usable recording modes judged by the recording mode limit unit when the recording mode set by the recording mode setting unit is not the usable recording mode.

11. The ink jet recording apparatus according to claim 9 further comprising:

a notice unit for notifying that the recording mode set by the recording mode setting unit is not suitable when the recording mode limit unit judges that the recording mode set by the recording mode setting unit is not suitable.

12. The ink jet recording apparatus according to claim 11, wherein the notice unit notifies that the recording mode is not suitable by sending an error code to a host computer.

13. The ink jet recording apparatus according to claim 9, wherein inks ejected respectively by the various kinds of drive signals generated by the drive signal generator are different in the minimum amount.

14. The ink jet recording apparatus according to claim 9, wherein the recording mode limit unit limits the usable recording modes to a part of the plurality of recording modes when a border free print mode in which printing is performed up to borders of a recording sheet is set.

15. The ink jet recording apparatus according to claim 9 further comprising:

a gap detector for detecting a platen gap from the nozzle opening, wherein the recording mode limit unit limits the usable recording modes to a part of the plurality of recording modes according to the platen gap detected by the gap detector.

16. An ink jet recording apparatus comprising:

a recording mode setting unit for setting a recording mode from a plurality of recording modes that are different in a correspondence of gradation data and amount of ink;

a drive signal generator for generating a drive signal, including drive pulses, selected from various kinds of drive signals according to the recording mode set by the recording mode setting unit;

a recording head for ejecting an ink droplet from a nozzle orifice thereof according to the selected drive pulses;

a recording mode limit unit for judging whether the recording mode set by the recording mode setting unit is a usable recording mode for recording wherein the plurality of recording modes are different in a minimum amount of ejected ink.

17. The ink jet recording apparatus according to claim 16, wherein the recording limit unit judges whether the recording mode set by the recording mode setting unit is a usable recording mode for recording according to whether a border free print mode in which printing is performed up to borders of a recording sheet is set or not.

18. The ink jet recording apparatus according to claim 16 further comprising:

a recording mode switching unit for switching the recording mode to one of the usable recording modes when the recording mode set by the recording mode setting unit is not the usable recording mode.

19. The ink jet recording apparatus according to claim 16, wherein inks ejected respectively by the various kinds of drive signals generated by the drive signal generator are different in the minimum amount.

20. An ink jet recording apparatus comprising:

a recording mode setting unit for setting a recording mode from a plurality of recording modes that are different in a correspondence of gradation data and amount of ink;

a drive signal generator for generating a drive signal, including drive pulses, selected from various kinds of drive signals according to the recording mode set by the recording mode setting unit;

a recording head for ejecting an ink droplet from an nozzle orifice thereof according to the selected drive pulses; and a recording mode limit unit for judging whether the recording mode set by the recording mode setting unit is a usable recording mode for recording wherein the recording limit unit judges whether the recording mode set by the recording mode setting unit is a usable recording mode for recording according to whether a border free print mode in which printing is performed up to borders of a recording sheet is set or not.

21. An ink jet recording apparatus comprising:

a recording mode setting unit for setting a recording mode from a plurality of recording modes that are different in a correspondence of gradation data and amount of ink;

a drive signal generator for generating a drive signal selected from various kinds of drive signals according to the recording mode set by the recording mode setting unit;

a recording head for ejecting an ink droplet from an nozzle orifice thereof according to the drive pulse;

a recording mode limit unit for judging whether the recording mode set by the recording mode setting unit is a usable recording mode for recording, and a notice unit for notifying that the recording mode set by the recording mode setting unit is not the usable recording mode when the recording mode limit unit judges that the recording mode set by the recording mode setting unit is not the usable recording modes.

22. An ink jet recording apparatus comprising:

a recording mode setting unit for setting a recording mode from a plurality of recording modes that are different in a correspondence of gradation data and amount of ink;

a drive signal generator for generating a drive signal selected from various kinds of drive signals according to the recording mode set by the recording mode setting unit;

a recording head for ejecting an ink droplet from an nozzle orifice thereof according to the drive pulse; and a recording mode limit unit for judging whether the recording mode set by the recording mode setting unit is a usable recording mode for recording, wherein the notice unit notifies that the recording mode is not the usable recording mode by sending an error code to a host computer.

* * * * *